US005854456A

United States Patent [19]

Lee-ven

[11] Patent Number: 5,854,456

[45] Date of Patent: Dec. 29, 1998

[54] LINE SWITCH HAVING A PARALLEL ARRANGEMENT BETWEEN CONDUCTING PLATES WITH PIERCING TIPS AND THE ELECTRICAL CORD

[76] Inventor: Liu Lee-ven, P.O. Box 55-175, Taichung, Taiwan

[21] Appl. No.: 898,034

[22] Filed: Jul. 22, 1997

[51] Int. Cl.[6] ..... H01H 19/58; H01H 19/20

[52] U.S. Cl. ..... 200/11 TW; 200/569

[58] Field of Search ..... 200/11 R, 11 TW, 200/298, 569; 439/401, 418, 425, 393, 658

[56] References Cited

U.S. PATENT DOCUMENTS 3,689,723 9/1972 Ludwig ..... 200/168 E 4,612,423 9/1986 Munroe ..... 200/16 R 4,816,623 3/1989 Huang ..... 200/11 R

*Primary Examiner*—Michael L. Gellner

*Assistant Examiner*—Michael J. Hayes

[57] ABSTRACT

A safety switch for controlling electric current between a plug and an appliance comprises generally an upper casing and a lower casing, a pair of copper conduct plates and a swivel disk member rotatably disposed into the casings. The improvement is characterized in that the pair of copper conduct plates each has a pair of staggered tip points pierced into a electrical cord having their flat portions parallel to the longitudinal axis of the cords. So that the tip points will not cut off the wires but stably engage with and grip a certain amount of the wires inside the cord in order to ensure an eligible conductivity of the electricity between the plug and the appliance.

5 Claims, 4 Drawing Sheets

LINE SWITCH HAVING A PARALLEL ARRANGEMENT BETWEEN CONDUCTING PLATES WITH PIERCING TIPS AND THE ELECTRICAL CORD

BACKGROUND OF THE INVENTION

The present invention relates to electrical switches, more particularly relates to a safety switch having a pair of structurally improved copper contact plates which have their flat staggered tip points pierced into the electrical cords parallel to the longitudinal axis of the cords so as to ensure a stable engagement of the tip points with the cores and an eligible conductivity between the tip points and the cords.

A safety switch is usually connected on a pair of electrical cords bewteen a plug and an electrical appliance for providing further protection to the appliance from a short circuit that may occur in the plug and for facilitating a remote control of the appliance which is away from the operator. Typical safety, switch (as shown in FIG. 1) comprises an upper and a lower casings 10 and 20 coupled by means of screw. The upper casing 10 has a protrudent central bore 11 projected upward from an inner surface, an enclosed wall 12 including a pair of slots 13 and 14 at two ends for receiving a pair of first and second anamelled electrical cards 15 and 16 which connect to a plug and an electrical appliance respectively with the second cord is broken up in the casing 10. The lower casing 20 has also a protrudent central bore 21 made in registry with the central bore 11, an enclosed wall 22 including a pair of elongate slots 23 and 24 at lateral sides, a pair of protrusions 25 and 26 projected upward from nearby two ends abutting a pair of retaining rods 27 formed in the inner surface of the end walls and the protrusions 25 and 26 and a plurality of coupling rods 28 projected upward from the opposing corners for engaging with the corresponding sockets 17 of the upper casing 10, and a pair of flat copper conduct plates 28 each including a transverse portion 281, a pair of tip points 282 projected upward from the top of the transverse portion 281 for piercing into the electrical cord 16, a slot 283 in the bottom of the transverse portion 281 for engaging with the retaining rods 27 and an elastic conducting portion 284 extended outward from a lateral side of the transverse portion 281 making an intersection angle with the transverse portion of about 45 degrees. A swivel disk 30 comprises a circular body 31 of serrated outer periphery including a pair of rectangular projections at opposite periphery, a roughly S-shaped protrusion 32 centrally projected upward from the planar surface having a central bore 33 through the body and a roughly elliptic-shaped copper plate 34 attached to the S-shaped protrusion 32. The plate 24 has a pair of the extensions 35 extended outward from the opposite peripheries of the elliptic-shaped each having a conducting portion perpendicular to the ends of the extension 35. When the disk 30 mounts to the protrudent central bore 21, it, will be partially exposed to outside of the slots 23 and 24 so as to facilitate rotation of the disk to switch on or off the appliance and when the upper casing 10 closes to the lower casing 20. The tip points 282 of the conduct plate 28 will be automatically pierced into the cord 16 respectively for connecting electric current from the cord 16. This safety switch provides a great convenience to the user but has also a great disadvantage such that the tip points 282 pierces into the cord 16, its flat portion is perpendicular to the longitudinal axis of the cord 16 so that the wires of the cord 16 may cut off by the tip point to cause insufficiency of the current and that the tip point is difficult to pierce into the cord 16 in place engageable with the wires so as to cause a power failure.

SUMMARY OF THE PRESENT INVENTION

The present invention has a main object to provide a safety switch having a pair of structurally improved copper conduct plates which has a pair of tip points pierced into a cord on their flat portion parallel to the longitudinal axis of the cord.

Another object of the present invention is to provide a safety which the tip points of the copper conduct plates which are staggered with each other so that, the wires will be partially gripped when they are pierced into the cord.

Still another object of the present invention is to provide a safety switch which has a pair of copper conduct plates can be readily pierced into the cord.

Further object of the present invention is to provide a safety switch when the copper conduct plates pierce into the cord, it will be more stable than the prior art and engageable to provide a nice electrical conductivity.

The present invention will become more fully understood by reference to the following detailed description thereof when read in conjunction with the attached drawings.

DETAILED DESCRIPTION OF THE PREFERRED EMBODIMENT

Figure 1:
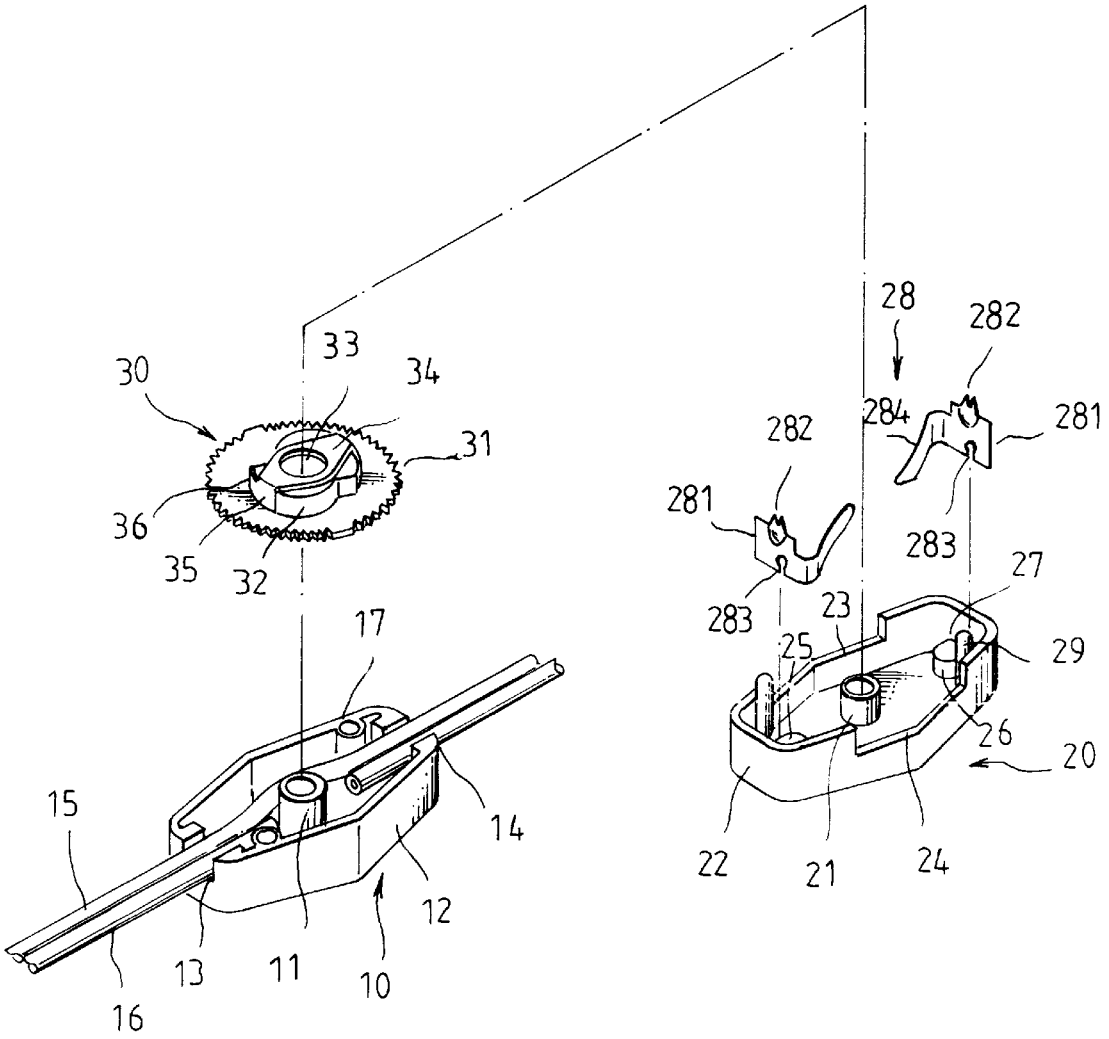
FIG. 1 PRIOR ART
FIG. 1 is an exploded perspective view to show a safety switch of a prior art.
Figure 2:
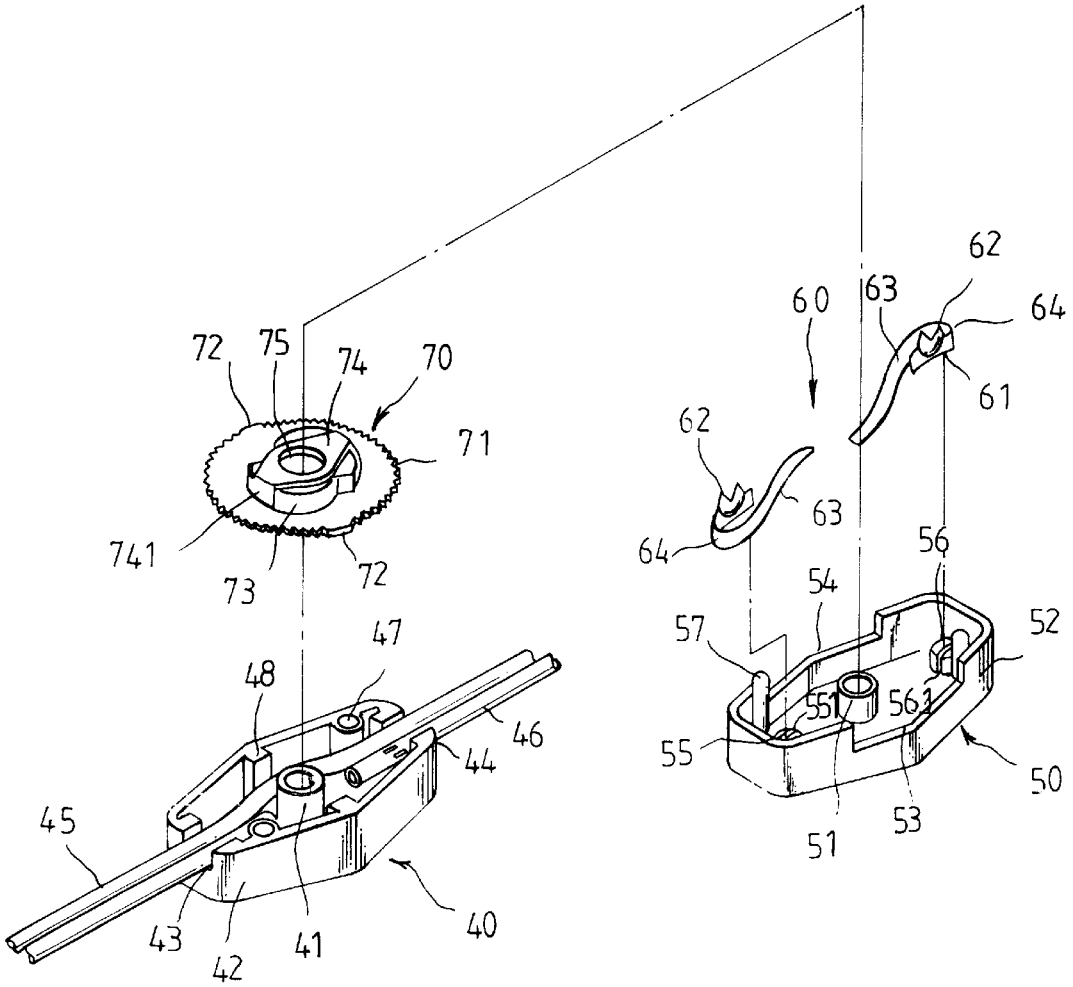
FIG. 2 is an exploded perspective view to show a preferred embodiment of a safety switch of the present invention.

With reference to FIG. 2 of the drawings, the safety switch of the present invention generally comprises an upper casing 40, a lower casing 50, a pair of copper conduct plates 60 and a swivel disk member 70.

The upper casing 40 comprises a protrudent central bore 41 projected inward from inner surface, an enclosure wall 42 therearound, a pair of slots 43 and 44 at two ends of the wall 42 for receiving a pair of first and second electrical cords 45 and 46 which connect, to an electrical plug and an appliance at their two ends respectively and are parallel disposed in the slots 43 and 44 with the second electrical cord 46 that is broken off, a pair of coupling sockets 37 oppositely formed abutting a corner of each end of the wall 42 and a pair of ribs 48 integrally formed on the medial inner surface of the opposing lateral walls.

The lower casing 50 comprises a protrudent central bore 51 made in registry with the central bore 41, an enclosure wall 52 engageable with the wall 42, a pair of elongate slots 53 and 54 centrally formed in the opposing lateral walls, a pair of positioning stems 55 and 56 symmetrically projected inward from the inner surface of the casing 50 along the longitudinal axis and adjacent the end walls thereof, each has a vertical retaining slot 551 and 561 centrally extended through the body thereof and along a longitudinal orientation, and a pair of posts 57 oppositely projected upward at a corner of each end wall.

Figure 3:
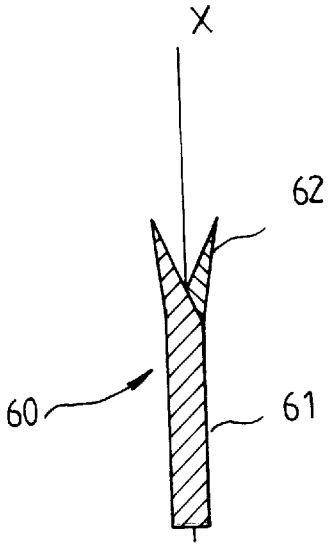
FIG. 3 is an elevational section view to show the pair of tip points of a copper conduct plate staggered with each other.

A pair of copper conduct plates 60, each has a flat rectangular portion 61 engaged into the retaining slot 551 and 561 and a pair of tip points 62 projected upward from the top of the rectangular portion 61 and an elastic conducting portion 63 extended inward from a transverse portion 64 first parallel to the rectangular portion and then making a bend of a predetermined angle. The pair of tip points 62 are staggered each other away from a vertical central axis (as shown in FIG. 3), when the copper conduct plates 60 engage into the respective retaining slots 551 and 561, their elastic conducting portions 63 will be positioned alternately and abutting the opposite peripheries of the protrudent central bore 51.

The swivel disk member 70 has a flat circular body 71 with serrated circumference and a pair of positioning marks 72, a roughly S-shaped protrusion 73 centrally projected downward from the planar portion of the body 71, a roughly elliptic copper plate 74 attached to the top of the protrusion 73 including a pair of conducting pieces 741 perpendicular to the narrower ends of the copper plate 74 and fixedly secured to the opposite vertical portions of the protrusion 73, and a central bore 75 through the centers of the copper plate 74, the S-shaped protrusion 73 and the circular body 71.

Figure 4:
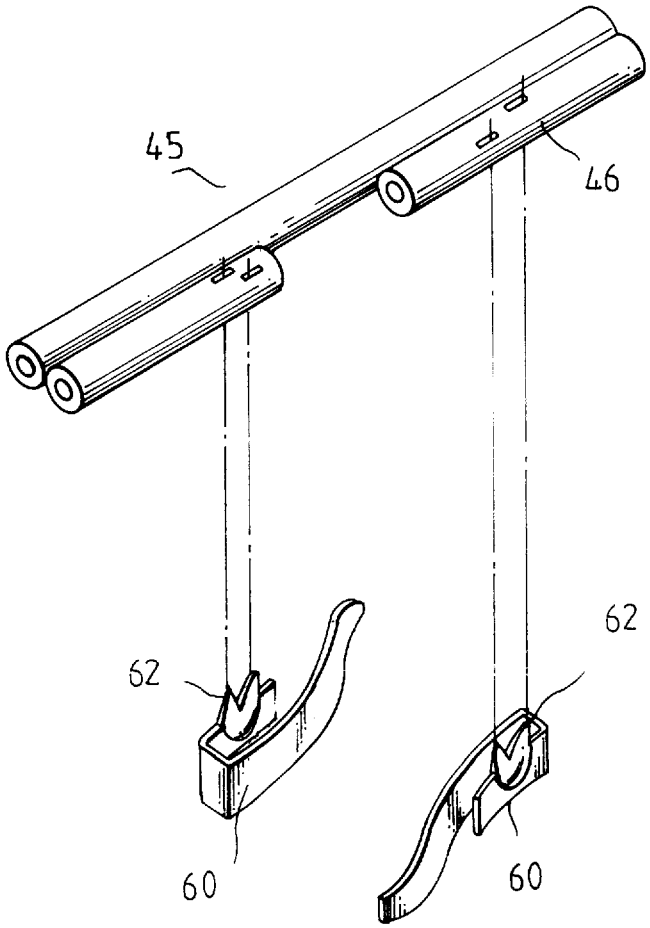
FIG. 4 is a perspective view to indicate the tip points pierced into the second electrical cord.
Figure 5:
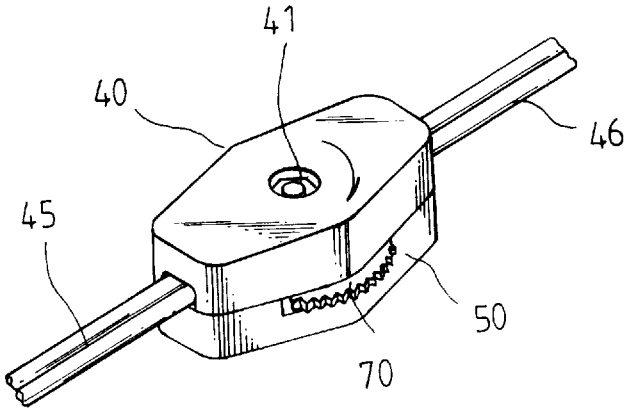
FIG. 5 is a perspective view to show an assembled safety switch of the present invention.

When assembly, the pair of copper conduct plates 60 are first engaged into the vertical retaining slots 551 and 561 of the stems 55 and 56 respectively in the manner as recited the above, secondly, engage the central bore 75 of the swivel disk member 70 onto the protrudent central bore 51 with the S-shaped protrusion 73 towards downward and the serrated circumference of the body 71 exposed to outside of the pair of elongate slots 53 and 54 but the positioning marks 72 positioned in place inside of the lower casing 50, and then close the upper casing 40 onto the lower casing 50 so that the posts 57 engage into the respective sockets 47, the central bore 51 engages with the corresponding central bore 41 and the pair of tip points 62 of the copper conduct plates 60 pierce into the second electrical cord 46 (as shown in FIG. 4) when applies a certain pressure to the casings 40 and 50, and final secures the casings 40 and 50 together by means of a screw and a castle nut through the central bores 41 and 51. FIG. 5 shows an assembled safety switch of the present invention.

Referring to FIG. 4, since the pair of tip points 62 are staggered away with each other, when they pierce into the second electrical cord 46, they will alternately engaged into the wires of the cord 46 and grip a certain amount of wires therebetween. Besides, their flat portions are parallel to the longitudinal axis of the cord 46, so that the piercing of the tip points 62 is more easier and smooth without cutting off the wires inside the cord 46. This improvement also ensures a stable engagement of the tip point 62 with the wires in the cord 46 that provides a eligible conductivity.

In operation, the user only rotates the swivel disk member 70 clockwise (as shown in FIG. 5) to engage or disengage the conducting pieces 741 of the copper plate 74 with the elastic conducting portions 63 of the copper conduct plate 60 at two ends of the casing 50 for turning on or off the safety switch, when the positioning marks 72 of the swivel disk member 70 appear at the slots 53 and 54, the switch is turned on, otherwise, it is turned off.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. a safety switch for controlling electricity between a plug and an appliance comprising:

an upper casing comprising a first protrudent central bore projected downward from an inner surface thereof, an enclosure wall therearound, a pair of first slots at two ends of said enlcosure wall for receiving a pair of first and second electrical cords which are parallel disposed and connect with a plug and an appliance at two ends respectively with said second cord being broken off inside said casing, a coupling socket projected downward from a corner of each end wall and a pair of ribs formed symmetrically abutting a pair of opposite lateral walls thereof;

a lower casing engageable with said upper casing and secured by means of screw, said lower casing comprising a second protrudent central bore made in registry with said first protrudent central bore, an enclosure wall engageable with the enclosure wall of said upper casing, a pair of elongate slots symmetrically formed in opposing lateral walls, a pair of positioning stems centrally projected inward from adjacent two ends of said enclosure wall thereof each including a vertical retaining slot centrally extended along a longitudinal orientation and a post projected upward at a corner of each end wall engageable with said coupling socket of said tipper casing;

a pair of copper conduct plates secured at two ends of said lower casing therein, said conduct plates each having a flat rectangular portion engaged into the vertical slot of said positioning stems including a pair of tip points parallel projected upward from a top thereof and staggered each other away from a vertical axis, a transverse portion extended from said rectangular portion and abutting said positioning stem, and an elastic conducting portion extended inward from said transverse portion first parallel to said rectangular portion and then bending a predetermined angle and terminated at a position adjacent an opposing periphery of said second protrudent central bore;

a swivel disk member rotatably engaged onto said second protrudent central bore of said lower casing, said disk member comprising a flat circular body of serrated outer circumference, a pair of positioning marks at opposite circumference, a S-shaped protrusion centrally projected downward from a planar portion of said body, an elliptic copper plate attached to a top of said protrusion including a pair of narrower portion extended outward from two ends each having a conducting piece perpendicular to free end thereof and fixedly secured to a vertical portion of opposite ends of said protrusion and a third central bore engageable with said second protrudent central bore formed through said elliptic copper plate and said protrusion;

whereby, said swivel disk member rotates to engage or disengage said conducting pieces with said pair of copper conduct plates inside said casing for controlling the electric current between a plug and an appliance.

2. A safety switch according to claim 1 wherein said tip points of said copper conduct plates have their flat portions parallel to the longitudinal axis of said pair of cords when it pierce into said second electrical cord.

3. A safety switch according to claim 2 wherein said tip points grips a certain amount of wires when it pierce into said second electrical cord.

4. A safety switch according to claim 1 wherein said switch is turned on when the positioning marks of said swivel disk member appear at the elongate slots of said lower casing.

5. A safety switch according to claim 4 wherein said switch is turned off when the positioning marks of said swivel disk member disappear from the elongate slots of said lower casing.

* * * * *